United States Patent [19]

Miller

[11] Patent Number: 4,967,840

[45] Date of Patent: Nov. 6, 1990

[54] PROCESS AND APPARATUS FOR FORMING A GASEOUS STREAM FOR INTRODUCTION INTO HYDROCARBON BEARING FORMATIONS AND GAS GENERATOR THEREFOR

[75] Inventor: Samuel A. Miller, Wayne, N.J.

[73] Assignee: Resource Production Management, Inc., Wayne, N.J.

[21] Appl. No.: 467,048

[22] Filed: Jan. 18, 1990

[51] Int. Cl.[5] ..... E21B 43/24; E21B 43/26

[52] U.S. Cl. ..... 166/303; 166/63; 166/308

[58] Field of Search ..... 166/63, 299, 303, 308, 166/59; 423/579; 60/39.462

[56] References Cited

U.S. PATENT DOCUMENTS

| | | | |
|---|---|---|---|
| 2,721,788 | 10/1955 | Schad | 60/39.462 X |
| 3,135,703 | 6/1964 | Sill | 60/39.462 X |
| 3,230,707 | 1/1966 | Rothmayer et al. | 60/39.462 X |
| 3,235,006 | 2/1966 | Hujsak | 166/302 |
| 4,069,664 | 1/1978 | Ellion et al. | 60/39.462 X |
| 4,423,780 | 1/1984 | Vigneri et al. | 166/63 X |
| 4,453,597 | 6/1984 | Brown et al. | 166/303 |
| 4,456,069 | 6/1984 | Vigneri | 166/303 |
| 4,475,596 | 10/1984 | Papst | 166/59 X |
| 4,589,488 | 5/1986 | Schirmer | 166/270 |
| 4,856,271 | 8/1989 | Burke | 60/39.462 X |

*Primary Examiner*—Stephen J. Novosad

*Attorney, Agent, or Firm*—Louis E. Marn

[57] ABSTRACT

There is disclosed an improved process and apparatus for generating a gaseous media for stimulating and/or fracturing a hydrocarbon bearing well formation comprised of a substantially horizontally-disposed gas generator having a first catalyst reaction bed, an expansion chamber, a second catalyst reaction bed, a venturi chamber for forming a gaseous stream to be introduced into the hydrocarbon bearing well formation.

27 Claims, 2 Drawing Sheets

PROCESS AND APPARATUS FOR FORMING A GASEOUS STREAM FOR INTRODUCTION INTO HYDROCARBON BEARING FORMATIONS AND GAS GENERATOR THEREFOR

BACKGROUND OF THE INVENTION (1) Field of the Invention

This invention relates to the recovery of hydrocarbons from geological formations, and more particularly to an improved process and apparatus for effecting secondary recovery of hydrocarbons from previously producing hydrocarbon bearing geological formations by the introduction of a gaseous stream to effect stimulation and/or fracturing and a gas generator assembly for producing such gaseous stream.

(2) Brief Descriptions of the Prior Art

The yields of hydrocarbons, such as gas and petroleum, from wells can be increased by stimulating and/or fracturing the formation so as to stimulate the flow of hydrocarbons in the well is known to those skilled in the art. Various formation stimulating and/or fracturing procedures have been proposed and many now are in use, e.g. treatments with various chemicals (usually acids in aqueous solutions), hydraulic fracturing in which liquids are injected under high pressure (usually with propping agents), explosive methods in which explosives are detonated within the formations to effect mechanical fracture, as well as combinations of such procedures.

Chemical treatments ususally involve the use of large volumes of chemicals which can be expensive and difficult to handle, and which pose problems of contamination and disposal. Hydraulic fracturing ordinarily requires that large volumes of liquids be made available at the well site and that equipment be made available for handling such large volumes of liquid. Again, there can be disposal problems, as well as contamination of the well. Explosive methods can be exceptionally hazardous from the standpoint of transporting and using the necessary explosives and present difficulties in controlling the effects of such a procedure.

Other suggestions for increasing the yield of existing wells entail heating the formation to induce the flow of hydrocarbons from the formation. Methods and apparatus have been developed by which various combustion devices have been lowered into the borehole of a well to attain heating of the formation adjacent the device. The effectiveness of such devices is limited by the necessity for fitting the devices into a borehole and then obtaining only more-or-less localized effects.

In U.S. Pat. No. 4,423,780 to Vigneri et al., there is disclosed a process and apparatus for increasing the yield of hydrocarbons from an underground hydrocarbon bearing well formation by placing and connecting a vertically-disposed gas generator in position outside the well for supplying heated gas under pressure to the opening of the borehole; essentially sealing the connection between the gas generator and the borehole opening so as to enable the establishment of elevated pressures within the well; operating the gas generator to inject gas into the well at a relatively high temperature, the high temperature being less than the thermal ignition temperature of the hydrocarbons in the formation; increasing the pressure within the well to an elevated relatively high pressure; and maintaining an elevated pressure in the well at least until the formation is fractured. Such process and apparatus while exhibiting a potential to improving the recovery of hydrocarbon from an otherwise uneconomically producing well, is inherently dangerous to operate presenting potentially hazardous operating conditions leading to explosive conditions. Additionally, the apparatus must be moved from site to site requiring considerable time and effort to connect same to existing well head with concomitant start-up problems.

OBJECTIONS OF THE PRESENT INVENTION

An object of the present invention is to provide an improved process and apparatus for stimulating and/or fracturing existing hydrocarbon bearing well formations.

Another object of the present invention is to provide an improved process and apparatus for stimulating and/or fracturing existing hydrocarbon bearing well formations capable of operations to maintain predetermined stimulated and/or fracturing conditions.

Still another object of the present invention is to provide an improved process and apparatus for stimulating and/or fracturing existing hydrocarbon bearing well formations under processing conditions minimizing potential hazardous effects.

Yet another object of the present invention is to provide an improved process and apparatus for stimulating and/or fracturing existing hydrocarbon bearing well formations operable under computer controlled direction.

A still further object of the present invention is to provide an improved gas generator for producing a gaseous stream to effect stimulation and/or fracturing of existing hydrocarbon bearing well formations.

SUMMARY OF THE INVENTION

These and other objects of the present invention are achieved by an improved process and apparatus for generating a gaseous media for stimulating and/or fracturing a hydrocarbon bearing well formation comprised of a substantially horizontally-disposed gas generator having a first catalyst reaction bed, an expansion chamber, a second catalyst reaction bed, a venturi chamber for forming a gaseous stream to be introduced into the hydrocarbon bearing well formation.

BRIEF DESCRIPTION OF THE DRAWINGS

The invention will be more clearly understood by reference to the following detailed description of an exemplary embodiment thereof, when taken in conjunction with the accompanying drawings wherein.

DETAILED DESCRIPTION OF THE INVENTION

Figure 1:
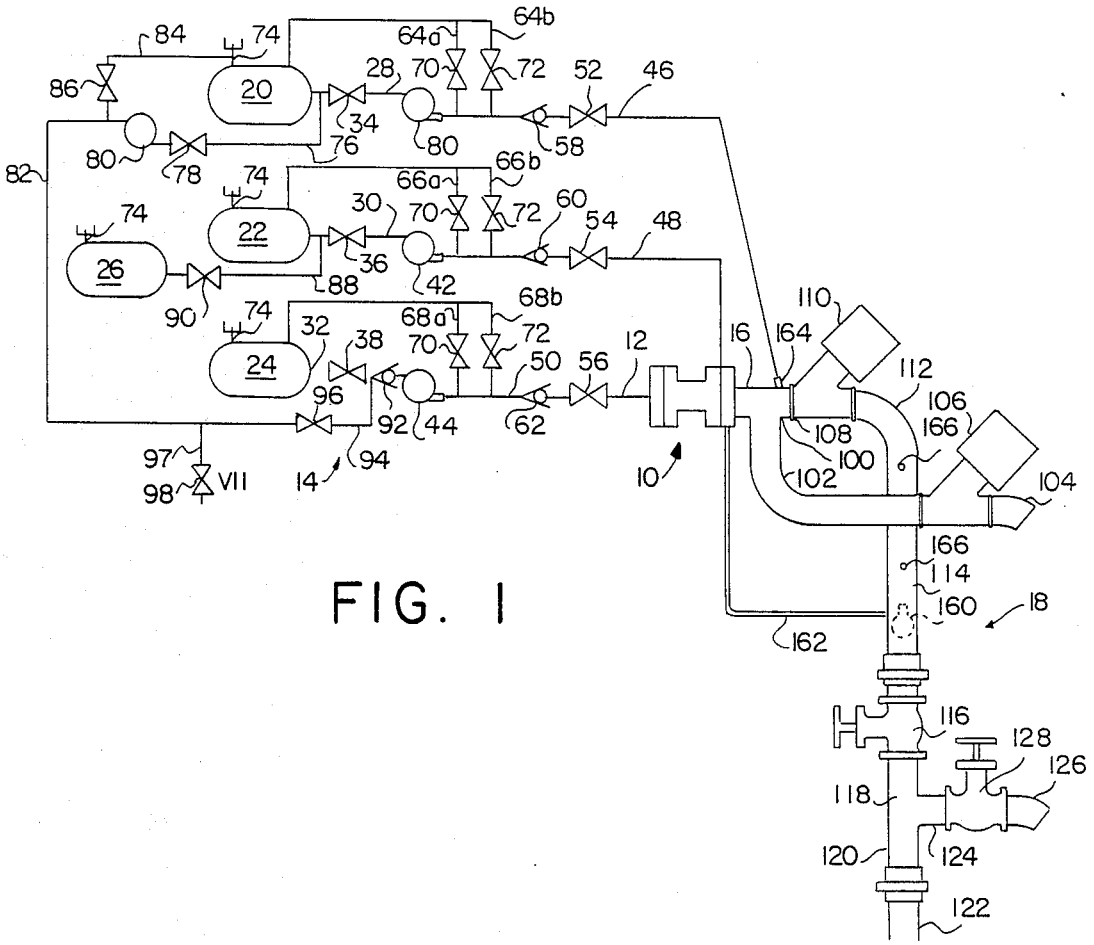
FIG. 1 is a schematic flow diagram of one embodiment of the present invention.

Referring now to the drawings, and in particular FIG. 1, there is illustrated a gas generator assembly, generally indicated as 10, connected by line 12 to fluid and fuel supply system, generally indicated as 14 and by conduit 16 to a gaseous delivery assembly, generally indicated as 18.

The fluid and fuel supply system 14 is comprised of storage tanks 20, 22, 24 and 26. The storage tanks 20, 22, 24 and 26 are connected by lines 28, 30 and 32 under the control of valves 34, 36 and 38 to the suction side of pumps 40, 42 and 44, respectively. The discharge side of the pumps 40, 42 and 44 are connected by lines 46, 48 and 50 under the control of valves 52, 54 and 56, respectively, as more fully hereinafter discussed. Line 46, 48 and 50 include one way check valves 58, 60 and 62 and recycle lines 64*a*, 66*a* and 68*a* including pressure relief valve 70 and recycle line 68*a*, 68*b* and 68*c* including control valve 72.

Each of the storage tanks 20, 22, 24 and 26 are provided with a fluid inlet line 74. A line 76 is connected to line 28 between storage tank 20 and the valve 34 under the control of valve 78 to the suction side of a pump 80. The discharge side of the pump 80 is connected to line 82 and to line 84 including a relief valve 86 connected to the fluid inlet line 74 of the storage tank 20. A line 88 under the control of valve 90 is connected to line 30 between the storage tank 22 and valve 36 and to the storage tank 26. Line 32 is provided with a one-way valve 92 upstream of the suction side of pump 44. A line 94 under the control of valve 96 is connected to line 32 between the valve 38 and the one-way valve 92 and to line 82 connected to line 97 under the control of valve 98.

The gaseous delivery assembly 18 is connected to the gas generator 10 by the conduit 16 and includes a conduit 100 having a vertical portion 102 connection to a by-pass conduit 104 including a pneumatic valve 106 to provide fluid communication to the atmosphere. A horizontal portion 108 of the conduit 100 is connected via a pneumatic valve 110 by an elbow 112 to a vertically-disposed conduit 114 having a shut-off-valve 116 connected to Tee conduit 118 having a portion 120 connected to well head conduit 122. A horizontal portion 124 of the Tee conduit 118 is connected via a conduit 126 under the control of valve 128 to a distribution system (not shown).

Figure 2:
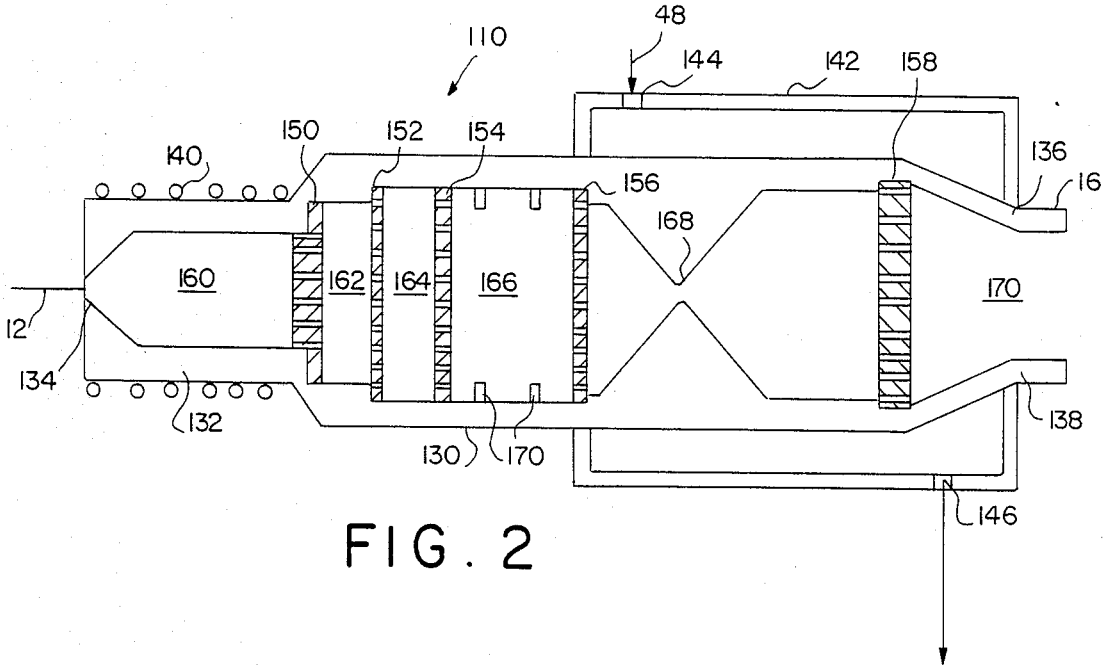
FIG. 2 is a schematic cross-sectional view of a preferred gas generator assembly of the present invention.

The gaseous reactor 10 may be of the type described in the aforementioned U.S. Pat. No. 4,423,780 to Vigneri et al., however, a particularly improved form of gaseous reactor 110, is illustrated in FIG. 2, may be used obviating certain gaseous by-pass features of the system of FIG. 1, as more fully hereinafter described. The gaseous reactor 110 provides for the formation of a gaseous stream obviating venting of start-up gaseous products, referring not to FIG. 2, is comprised of a generally cylindrically-shaped housing 130 having an inlet portion 132 including a fuel inlet 134 and a discharge portion 136 including a gaseous product outlet 138 in fluid communication with conduit 16.

An electric heating coil 140 is circumferentially positioned about the inlet portion 132 of the housing 130. A cylindrically-shaped shell 142 is provided including inlet and outlet orifices 144 and 146, respectively, encircling a portion of the housing 130 about the discharge portion 136 thereof. A plurality of perforated plate members 150, 152, 154, 156 and 158 are sequentially disposed in the housing 130 from the inlet portion 132 to the discharge portion 136 in co-axial alignment and define a preheat nozzle 160 by the perforated plate 150 with the inlet 134, a first catalyst bed 162 by perforated plates 150 and 152, an expansion zone 164 by perforated plates 152 and 154, a second catalyst bed 166 by perforated plates 154 and 156, a venturi chamber 168 between perforated plates 156 and 158 and a discharge chamber 170 after perforated plate 158.

As discussed in the Vigneri et al. patent, hydrogen peroxide $H_2O_2$) may be a suitable fuel which is decomposable in the presence of a suitable catalyst, such as silver, to generate high temperature steam and oxygen for injection into the well head. In accordance with the present invention, liquid hydrogen peroxide having a composition of from 70 to 95, preferably about 85 percent by weight hydrogen peroxide is used and is critical to the successful operation of the gas generator 110. Insufficient volumes of a gaseous stream at low temperatures result at concentrations of less than about 70 percent by weight; a generally explosive and/or dangerous condition can exist if concentrations are about about 95 percent by weight.

A silver catalyst, or any other catalyst capable of decomposing hydrogen peroxide is contemplated in the present invention. The catalyst bed 162 is comprised of catalyst bed of low density packing to permit a preliminary increase in energy level of the reactant mixture. The catalyst bed 166 is similarly comprised of silver catalyst, however, in high density packing to effect complete decomposition of the hydrogen peroxide. Annularly-disposed baffles 170 are provided in the chamber of the catalyst bed 166 to minimize channelling of gases passing therethrough.

The venturi chamber 168 is configured to reduce the pressure of the gaseous stream generated in the catalyst bed 166 to a pressure level generally not greater than about 1750 psig at relatively low velocities to permit introduction into the well head and thereby effect stimulation and/or fracturing of the hydrocarbon formation without achieving a temperature level above the thermal ignition temperature of the hydrocarbons in the formation. Temperature control of the gaseous stream introduced into the well head 122 is modulated by controlled injection of water and/or water vapor-surfactants using a venturi nozzle assembly 160 positioned within the conduit 114 and in fluid communication via line 162 with the orifice 146 of the shell 142.

The process and apparatus of the present invention contemplates a substantially horizontal positioning of the gas generator 10, referring now to FIG. 1, to minimize any potential for inappropriate start-up operation of the gaseous generator and concomitant deleterious effects, such as the introduction of unreactive hydrogen peroxide into the well head. In this context, the gas generator is positioned at an angle of about 90°, but may be at an angle of from about 30° to 0° (inlet to outlet) with the vertical. The gas generator should not be positioned to permit liquid hydrogen peroxide to drain through the catalyst beds towards the gaseous product outlet 138.

In the process and apparatus of FIG. 1, the tanks 20, 22, 24 and 26 are supplied via feed line 74 with $H_2O_{(l)}$ to tank 20, aqueous surfactant solutions to tank 22, $H_2O_{2(l)}$ to tank 24 and penetrating chemicals to tank 26. Activation of the pumps 40, 42, 44, 46 and 80, the valves 34, 36 and 38 being opened and the valves 52, 54 and 56 being closed, permit recirculating fluid flow therebetween under control of pressure relief valves 70. Initially, valve 52 is opened to permit flushing with water via line 46 of the related conduits of the gas delivery assembly 18 via a nozzle assembly 164 positioned in the conduit 100; pneumatic valve 110 being closed and pneumatic valve 106 being open thereby discharging or venting a gas-water stream. Thereafter, the valve 56 is opened together with regulated flow through (valve 52 being closed) to introduce by line 12 into the gaseous reactor 10, liquid hydrogen peroxide in a concentration of from 70 to 95 percent by weight. A high temperature gaseous stream is formed in the gas generator 10 and is withdrawn by conduit 16 and vented to atmosphere via conduit 104 under the control of pneumatic valve 106.

Once the gaseous stream in conduit 100 has reached a required operational temperatures of from about 800° to 1000° F. at a pressure level of from about 500 to 1500 psig, pneumatic valve 110 is opened and pneumatic valve 106 closed to permit injection of the gaseous stream via the conduits 114 and 120 into the well head 122, it being understood that valve 116 is open and valve 128 is closed. Injection of the gaseous stream is continued with concomitant measuring of well head pressure until a pressure level of less than about 1750 psig is achieved whereupon the gas generation process is discontinued in a shut-down protocol or gas generation continued with venting of gas and pressurizing of the well head by alternate opening and closing of pneumatic valves 106 and 110 until a predetermined substantially constant pressure level is attained whereupon gas generation is discontinued. As hereinabove discussed, it is critical that the gas generator 10 be maintained in a substantially horizontal position.

It will be understood by one skilled in the art of stimulation and/or fracturing of hydrocarbon bearing formations, that pressure and temperature ranges and levels of stimulation and/or fracturing are governed inter alia, by the existing well head materials of construction, type and composition of hydrocarbon bearing formations, etc. Thus, continued introduction of the gaseous stream to achieve maximum effective pressure levels may be limited by the capabilities of the materials of construction which may fail should pressure levels be achieved desireable for maximum effective stimulation but beyond the capabilities of the equipment. Thus, pressure and temperature levels of the gaseous stream are varied given several considerations, limited to temperature below ignition temperatures of the formation and above about 450° F. as hereinabove discussed. Similarly, pressure levels are a function of the well head equipment and levels required by the existing hydrocarbon bearing formation.

A particularly preferred form of gas generator 110 is illustrated in FIG. 2 obviating the necessity of any start-up venting of gases thereby permitting the direct introduction of generated gases upon initiation of fuel flow to the gas generator 110. In operation, liquid hydrogen peroxide feed stream in line 32 from tank 24 is introduced by line 12 into the preheat chamber 160 of the gas generator 110 heated by electric coils 140 to a temperature of less than about 400° F. whereupon the preheat feed mixture is thereupon introduced via perforated plate 150 into the catalyst bed 162 and thence via plate 152 into expansion chamber 164 for equalization of fuel distribution. The expanded fluid is then passed from expansion zone 164 via perforated plate 154 into the second catalyst bed (dense packing) 166 to effect completion of the decomposition reaction, as known to one skilled in the art.

A high pressure, high temperature gaseous stream, as hereinabove discussed, is passed via perforated plate 156 into the venturi chamber 168 to form a low pressure, high temperature gas stream passed through perforated plate 158 into the discharge zone 138 for introduction into the conduit 16 for passage into the well head 122 via the gas delivery assembly 18. The gaseous temperature of the gaseous stream in the discharge zone 138 is at least about 450° F. Since the gaseous stream available from the discharge zone 138 is at high temperatures, additional gas in the form of steam may be generated by introducing water, chemicals, surfactants, etc. into such gaseous stream via a venturi nozzle 160 in conduit 114 via the orifice 146 from the shell 142.

Steam at very high temperatures, considering heat of vaporization, tends to remain at high temperatures without excessive condensation, as a result of the elevated pressures in the well and the low delivery velocity. Thus, the elevated pressures serve to maintain the high temperature for a longer period of time while also supplying a driving force to achieve simultaneous and/or fracturing of the formation. The presence of oxygen provides the added benefit of sterilizing the well by oxidation. The presence of steam and oxygen poses no problem of contamination or disposal. The amount of water remaining after the steam is condensed is very little in comparison to the amounts of water required in other formation fracturing processes. The benign nature of the decomposition gases and the ease with which the gases are generated quickly in the quantities required and then disposed of enables the process to be used repeatedly, if necessary, without excessive logistical problems, without contamination of the well or the well environment, and without the requirement for any periodic turn arounds including non-productive clean-up pumping of the well to expell fracturing materials or by-products.

Should the temperature of the gaseous stream in line 114 drops below about 450° F., as sensed by thermocouples 166, pneumatic valve 110 is caused to close with concomitant opening of pneumatic valve 106 to vent to atmosphere any such gaseous stream. As hereinabove discussed, a gaseous stream in conduit 114 below about 450° F. may contain unreacted hydrogen peroxide which could produce deleterious results. Concomitantly, resumption of flow of the gaseous stream from the gas generator 110 to the well head should not be effected until the temperature level thereof exceeds about 450° F.

While the invention has been described in connection with an exemplary embodiment thereof, it will be understood that many modifications will be apparent to those of ordinary skill in the art; and that this application is intended to cover any adaptations of variations thereof. Therefore, it is manifestly intended that this invention be only limited by the claims and the equivalents thereof.

What is claimed is:

1. An apparatus for introducing a gaseous stream into a hydrocarbon bearing geological formation including a well head conduit for said geological formation for effecting stimulation and/or fracturing, which comprises;

a substantially horizontally-disposed gas generator having a fuel preheat zone, a first catalyst bed, a mixing zone, a second catalyst bed and a pressure reducing zone;

conduit for introducing a liquid hydrogen peroxide having a concentration of from 70 to 95 weight percent into said fuel preheat zone of said gas generator; and conduit means for directly introducing into said well head conduit a gaseous stream from said pressure reducing zone of said gas generator.

2. The apparatus for introducing a gaseous stream into a hydrocarbon bearing geological formation as defined in claim 1 wherein said gaseous stream is of a temperature of at least about 450° F.

3. The apparatus for introducing a gaseous stream into a hydrocarbon bearing geological formation as defined in claim 1 and further including means to sense temperature of said stream and valve means to discontinue flow of said gaseous stream into said well head at a temperature below about 450° F.

4. The apparatus for introducing a gaseous stream into a hydrocarbon bearing geological formation as defined in claim 1 and further including means to flush said conduit means prior to introducing said gaseous stream into said well head conduit.

5. The apparatus for introducing a gaseous stream into a hydrocarbon bearing geological formation as defined in claim 1 and further including valve-means in said conduit means for venting to atmosphere said gaseous stream.

6. The apparatus for introducing a gaseous stream into a hydrocarbon bearing geological formation as defined in claim 5 and further including a second valve means for cooperating with said valve means to effect flow of gaseous stream into said wall head with concomitant discontinuance of venting flow.

7. The apparatus for introducing a gaseous stream into a hydrocarbon bearing geological formation as defined in claim 1 and further including a venturi means in said conduit means for introducing an aqueous liquid into said gaseous stream.

8. The apparatus for introducing a gaseous stream into a hydrocarbon bearing geological formation as defined in claim 7 wherein said liquid is water.

9. The apparatus for introducing a gaseous stream into a hydrocarbon bearing geological formation as defined in claim 7 wherein said liquid is an aqueous surfactant solution.

10. The apparatus for introducing a gaseous stream into a hydrocarbon bearing geological formation as defined in claim 8 and further including penetrating chemicals.

11. The apparatus for introducing a gaseous stream into a hydrocarbon bearing geological formation as defined in claim 7 wherein a liquid stream is passed in indirect heat transfer relationship through said gas generation prior to passage to said venturi means.

12. An improved process for introducing a gaseous stream into a hydrocarbon bearing geological formation for effecting stimulation and/or fracturing including a well head conduit which comprises;

(a) introducing into a gas generator hydrogen peroxide in a concentration of from 70 to 95 percent by weight;

(b) passing said stream of step (a) into a first catalyst bed thereof to partially decompose hydrogen peroxide;

(c) introducing a stream produced by step (b) into an expansion zone thereof;

(d) introducing said stream of step (c) into a second catalyst bed thereof to complete decomposition of hydrogen peroxide to form a high pressure, high temperature gaseous stream;

(e) reducing pressure of said high pressure, high temperature gaseous stream of step (d); and (f) introducing into said well head conduit said gaseous stream of step (e).

13. The improved process for introducing a gaseous stream into said hydrocarbon bearing geological formation as defined in claim 12 wherein said gaseous stream of step (f) is at a temperature of at least about 450° F.

14. The improved process for introducing a gaseous stream into a hydrocarbon bearing geological formation as defined in claim 12 and further including the steps of sensing temperature of said gaseous stream of step (f) and discontinuing flow of said gaseous stream at a gaseous stream temperature below about 450° F.

15. The improved process for introducing a gaseous stream into a hydrocarbon bearing geological formation as defined in claim 14 and further including the step of venting to atmosphere said gaseous stream at a temperature of below about 450° F.

16. The improved process for introducing a gaseous stream into a hydrocarbon bearing geological formation as defined in claim 12 and further including the step of introducing an aqueous liquid stream into said gaseous stream of step (e) prior to step (f).

17. The improved process for introducing a gaseous stream into a hydrocarbon bearing geological formation as defined in claim 16 wherein an aqueous liquid is passed in indirect heat transfer relationship with said gaseous stream of step (c) and constitutes said aqueous liquid stream introduced into said gaseous stream of step (f).

18. The improved process for introducing a gaseous stream into a hydrocarbon bearing geological formation as defined in claim 16 and further including the step of admixing penetrating chemicals with said aqueous liquid stream.

19. The improved process for introducing a gaseous stream into a hydrocarbon bearing geological formation as defined in claim 16 wherein said aqueous liquid is an aqueous surfactant solution.

20. A gaseous generator for forming a gaseous stream from hydrogen peroxide for introduction into a hydrocarbon bearing geological formation, which comprises:

a generator housing having a chamber and provided with a plurality of perforated plates therein defining a first catalyst bed, an expansion chamber, a second catalyst bed and a pressure reduction chamber, said catalyst beds including a catalyst for decomposing hydrogen peroxides;

an inlet for introducing into said gas generator liquid hydrogen peroxide having a concentration of from 70 to 95 percent by weight; and an outlet for withdrawing a gaseous stream produced by the catalytic decomposition of hydrogen peroxide.

21. The gaseous generator as defined in claim 20 wherein said first catalyst bed is of loosely packed catalyst particles.

22. The gaseous generator as defined in claim 20 or 21 wherein said second catalyst bed is of densely packed catalyst particles.

23. The gaseous generator as defined in claim 20 and further including a preheat chamber prior to said first catalyst bed.

24. The gaseous generator as defined in claim 23 wherein an electrical heating conduit is wound about said preheat chamber.

25. The gaseous generator as defined in claim 22 and further including an annularly-disposed baffle in said second catalyst bed.

26. The gaseous generator as defined in claim 20 and further including a shell member surrounding said housing of said gas generator proximate said pressure reduction chamber thereof defining a heat transfer chamber with said housing.

27. The gaseous generator as defined in claim 26 and further including means for introducing and withdrawing a heat transfer liquid into and from said heat transfer chamber.

* * * * *